US010587959B2

(12) United States Patent
Matsuda

(10) Patent No.: US 10,587,959 B2
(45) Date of Patent: Mar. 10, 2020

(54) ACOUSTIC CONVERSION APPARATUS AND SOUND OUTPUT EQUIPMENT

(71) Applicant: SONY CORPORATION, Tokyo (JP)

(72) Inventor: Koji Matsuda, Aichi (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/743,935

(22) PCT Filed: Jun. 10, 2016

(86) PCT No.: PCT/JP2016/067390
§ 371 (c)(1),
(2) Date: Jan. 11, 2018

(87) PCT Pub. No.: WO2017/018074
PCT Pub. Date: Feb. 2, 2017

(65) Prior Publication Data

US 2018/0206041 A1 Jul. 19, 2018

(30) Foreign Application Priority Data

Jul. 29, 2015 (JP) ..... 2015-150023

(51) Int. Cl.
*H04R 11/02* (2006.01)
*H04R 7/12* (2006.01)
*H04R 7/16* (2006.01)

(52) U.S. Cl.
CPC ..... *H04R 11/02* (2013.01); *H04R 7/12* (2013.01); *H04R 7/16* (2013.01); *H04R 2400/11* (2013.01)

(58) Field of Classification Search
CPC ..... H04R 1/00; H04R 2205/022; H04R 2201/401; H04R 2201/405; H04R 9/025; H04R 9/027
USPC ..... 381/182, 417–418
See application file for complete search history.

(56) References Cited

U.S. PATENT DOCUMENTS 3,573,397 A * 4/1971 Sawyer ..... H04R 7/20 381/423
3,742,156 A * 6/1973 Broersma ..... H04R 11/00 381/386

(Continued)

FOREIGN PATENT DOCUMENTS

CN 101394684 U 3/2009
CN 102291649 A 12/2011

(Continued)

OTHER PUBLICATIONS

International Search Report and Written Opinion of PCT Application No. PCT/JP2016/067390, dated Aug. 30, 2016, 10 pages of ISRWO.

(Continued)

*Primary Examiner* — Suhan Ni
(74) *Attorney, Agent, or Firm* — Chip Law Group

(57) ABSTRACT

To improve acoustic characteristics without increasing the manufacturing cost or increasing the size. Provided are a drive unit and a vibration plate unit. The drive unit includes a yoke formed by a magnetic material, magnets attached to the yoke, a coil to which a drive current is supplied, and an armature provided with a vibration portion that vibrates when the drive current is supplied to the coil. The vibration plate unit includes a holding frame including an opening, a film covering the opening and pasted on the holding frame, a vibration plate pasted on the film and held inside of the holding frame, and a transmission beam that transmits vibration of the vibration portion to the vibration plate. An entire circumference of an outer circumference of the vibration plate is isolated from an entire circumference of an inner circumference of the holding frame.

13 Claims, 15 Drawing Sheets

(56) References Cited

U.S. PATENT DOCUMENTS

| | | | | |
|---|---|---|---|---|
| 3,935,398 | A * | 1/1976 | Carlson | H04R 11/00 381/386 |
| 4,410,769 | A * | 10/1983 | Tibbetts | H04R 11/00 381/176 |
| 6,853,735 | B2 * | 2/2005 | Imahori | H04M 1/0202 381/418 |
| 7,110,565 | B1 * | 9/2006 | Engbert | H04R 7/18 381/324 |
| 7,706,561 | B2 * | 4/2010 | Wilmink | H04R 7/18 381/324 |
| 8,792,672 | B2 * | 7/2014 | van Halteren | H04R 1/2873 381/418 |
| 2002/0142795 | A1 | 10/2002 | Imahori et al. | |
| 2011/0311090 | A1 | 12/2011 | Nagumo et al. | |
| 2012/0255805 | A1 | 10/2012 | Van Halteren et al. | |

FOREIGN PATENT DOCUMENTS

| | | | |
|---|---|---|---|
| CN | 102291650 | A | 12/2011 |
| CN | 203399283 | U | 1/2014 |
| CN | 204350292 | U | 5/2015 |
| CN | 204350296 | U | 5/2015 |
| CN | 204377128 | U | 6/2015 |
| JP | 58-106998 | A | 6/1983 |
| JP | 2001-245390 | A | 9/2001 |
| JP | 2006-041768 | A | 2/2006 |
| JP | 2012-004850 | A | 1/2012 |
| JP | 2012-004851 | A | 1/2012 |
| JP | 2012-004852 | A | 1/2012 |
| JP | 2012-004853 | A | 1/2012 |
| JP | 2012-129838 | A | 7/2012 |

OTHER PUBLICATIONS

Office Action for CN Patent Application No. 201680042836.5, dated Sep. 23, 2019, 09 pages of Office Action and 05 pages of English Translation.

Office Action for JP Patent Application No. 2017-531073, dated Jan. 14, 2020, 07 pages of Office Action and 05 pages of English Translation.

* cited by examiner

ACOUSTIC CONVERSION APPARATUS AND SOUND OUTPUT EQUIPMENT

CROSS REFERENCE TO RELATED APPLICATIONS

This application is a U.S. National Phase of International Patent Application No. PCT/JP2016/067390 filed on Jun. 10, 2016, which claims priority benefit of Japanese Patent Application No. JP 2015-150023 filed in the Japan Patent Office on Jul. 29, 2015. Each of the above-referenced applications is hereby incorporated herein by reference in its entirety.

TECHNICAL FIELD

The present technique relates to a technical field of an acoustic conversion apparatus including a transmission beam that transmits vibration of a vibration portion in an armature to a vibration plate and sound output equipment including the acoustic conversion apparatus.

CITATION LIST

Patent Literature

[PTL 1]
JP 2012-4850A
[PTL 2]
JP 2012-4851A
[PTL 3]
JP 2012-4852A
[PTL 4]
JP 2012-4853A

BACKGROUND ART

There is an acoustic conversion apparatus incorporated into various sound output equipment, such as a headphone, an earphone, and a hearing aid, and the acoustic conversion apparatus includes a vibrator called an armature and functions as a small speaker.

In such an acoustic conversion apparatus, a drive unit including the armature and a vibration plate unit including a vibration plate are stored in a storage case, a transmission beam transmits vibration to the vibration plate when a vibration portion of the armature is vibrated, and sound according to the vibration of the vibration plate is output (for example, see PTL 1 to PTL 4).

In acoustic conversion apparatuses described in PTL 1 to PTL 4, a resin film is pasted on a holding frame, a vibration plate is pasted on the resin film, and one end portion of the vibration plate is fixed to the holding frame by an adhesive. A beam portion (transmission beam) is bent from the other end portion of the vibration plate and formed integrally with the vibration plate, and a tip portion of the beam portion is fixed by an adhesive to a tip portion of a vibration portion in an armature.

Therefore, when a current is supplied to a coil to vibrate the vibration portion, the vibration of the vibration portion is transmitted from the transmission beam to the vibration plate. The vibration plate is vibrated, and sound according to the vibration of the vibration plate is output. Here, since the one end portion is fixed to the holding frame by the adhesive, the vibration plate is vibrated in a cantilever state with the bonding part as a fulcrum. In this way, the vibration of the vibration plate with the bonding part as a fulcrum particularly reduces variations of sound pressure in a high frequency region, and stable sound pressure can be obtained.

SUMMARY

Technical Problems

Incidentally, since the acoustic conversion apparatus is used not only in the high frequency region, but also in a low frequency region, it is desirable to also improve the acoustic characteristics in the low frequency region.

An example of means for improving the acoustic characteristics not only in the high frequency region, but also in the low frequency region includes means for increasing the amplitude of a drive portion in the armature. However, the input voltage and the conversion efficiency need to be increased in this case, and this may lead to an increase in the power consumption.

Furthermore, another example of the means for improving the acoustic characteristics not only in the high frequency region, but also in the low frequency region includes means for increasing the area of the vibration plate. However, in this case, the sizes of other members, such as the holding frame, also need to be increased according to the enlargement of the vibration plate, and this may lead to an increase in the sizes of the acoustic conversion apparatus and sound output equipment including the acoustic conversion apparatus.

Therefore, an object of an acoustic conversion apparatus and sound output equipment of the present technique is to overcome the problems described above to improve the acoustic characteristics without increasing the manufacturing cost or increasing the size.

Solution to Problems

First, an acoustic conversion apparatus according to the present technique includes a drive unit and a vibration plate unit. The drive unit includes a yoke formed by a magnetic material, magnets attached to the yoke, a coil to which a drive current is supplied, and an armature provided with a vibration portion that vibrates when the drive current is supplied to the coil. The vibration plate unit includes a holding frame including an opening, a film covering the opening and pasted on the holding frame, a vibration plate pasted on the film and held inside of the holding frame, and a transmission beam that transmits vibration of the vibration portion to the vibration plate. An entire circumference of an outer circumference of the vibration plate is isolated from an entire circumference of an inner circumference of the holding frame.

As a result, the vibration plate is held by the film inside of the inner circumference of the holding frame, and the vibration plate easily makes translational motion in the thickness direction when the vibration is transmitted from the transmission beam to the vibration plate.

Second, in the above acoustic conversion apparatus, it is desirable that a distance between the entire circumference of the outer circumference of the vibration plate and the entire circumference of the inner circumference of the holding frame be constant.

As a result, the distance between the outer circumference of the vibration plate and the inner circumference of the holding frame is constant throughout the entire circumference.

Third, in the above acoustic conversion apparatus, it is desirable that the inner circumference at corner portions of the holding frame be formed in a curved shape.

As a result, stress is not concentrated on the corner portions of the holding frame when the vibration plate is vibrated.

Fourth, in the above acoustic conversion apparatus, it is desirable that the outer circumference at corner portions of the vibration plate be formed in a curved shape.

As a result, stress is not concentrated on the corner portions of the vibration plate when the vibration plate is vibrated.

Fifth, in the above acoustic conversion apparatus, it is desirable that the transmission beam be formed by bending the transmission beam from the vibration plate.

As a result, the transmission beam and the vibration plate are integrally formed.

Sixth, in the above acoustic conversion apparatus, it is desirable that the transmission beam include a base portion continuous with the vibration plate, and a coupling portion continuous with the base portion and coupled to the vibration portion, and a width of the base portion be larger than a width of the coupling portion.

As a result, the width of the continuous part of the transmission beam continuous with the vibration plate is large, and the strength of the transmission beam is high.

Seventh, in the above acoustic conversion apparatus, it is desirable that the width of the base portion and the width of the coupling portion be both constant.

As a result, the base portion and the coupling portion have the same strengths regardless of the positions of the base portion and the coupling portion in the continuous direction.

Eighth, in the above acoustic conversion apparatus, it is desirable that reinforcing ribs be formed on the vibration plate.

As a result, the strength of the vibration plate is high, and the curvature of the vibration plate is reduced during the vibration.

Ninth, in the above acoustic conversion apparatus, it is desirable that a rib be formed on the transmission beam.

As a result, the strength of the transmission beam is high, and the curvature of the transmission beam is reduced during the vibration.

Tenth, in the above acoustic conversion apparatus, it is desirable to further include a storage unit including a case body that stores the drive unit and the vibration plate unit, and a cover body, the storage unit being provided with a sound output hole that outputs sound generated when the vibration is transmitted to the vibration plate.

As a result, the drive unit and the vibration plate unit are protected by the storage unit.

Eleventh, sound output equipment according to the present technique includes a first acoustic conversion apparatus and a second acoustic conversion apparatus, both the first acoustic conversion apparatus and the second acoustic conversion apparatus including a drive unit and a vibration plate unit. The drive unit includes magnets, a coil to which a drive current is supplied, and an armature provided with a vibration portion that vibrates when the drive current is supplied to the coil. The vibration plate unit includes a holding frame including an opening, a film covering the opening and pasted on the holding frame, a vibration plate pasted on the film and held inside of the holding frame, and a transmission beam that transmits vibration of the vibration portion to the vibration plate. An entire circumference of an outer circumference of the vibration plate in the first acoustic conversion apparatus is isolated from an entire circumference of an inner circumference of the holding frame, and one end portion of the vibration plate in the second acoustic conversion apparatus is fixed to an inner circumference portion of the holding frame.

As a result, the vibration plate is held by the film inside of the inner circumference of the holding frame in the first acoustic conversion apparatus, and the vibration plate easily makes translational motion in the thickness direction when the vibration is transmitted from the transmission beam to the vibration plate.

Twelfth, in the above sound output equipment, it is desirable that the transmission beam be formed by bending the transmission beam from the vibration plate in both the first acoustic conversion apparatus and the second acoustic conversion apparatus, and a width of a bent part of the transmission beam bent from the vibration plate in the first acoustic conversion apparatus be larger than a width of a bent part of the transmission beam bent from the vibration plate in the second acoustic conversion apparatus.

As a result, the transmission beam of the first acoustic conversion apparatus and the transmission beam of the second acoustic conversion apparatus are formed with strengths suitable for a low frequency region and a high frequency region, respectively.

Thirteenth, in the above sound output equipment, it is desirable that a thickness of the vibration plate in the first acoustic conversion apparatus be thicker than a thickness of the vibration plate in the second acoustic conversion apparatus.

As a result, the vibration plate of the first acoustic conversion apparatus and the vibration plate of the second acoustic conversion apparatus are formed with strengths suitable for the low frequency region and the high frequency region, respectively.

Advantageous Effect of Invention

In the acoustic conversion apparatus and the sound output equipment of the present technique, the vibration plate is held by the film inside of the inner circumference of the holding frame, and the vibration plate easily makes translational motion in the thickness direction when the vibration is transmitted from the transmission beam to the vibration plate. Therefore, the acoustic characteristics can be improved without increasing the manufacturing cost or increasing the size.

BRIEF DESCRIPTION OF DRAWINGS

FIG. 1 is an exploded perspective view of the acoustic conversion apparatus.

DESCRIPTION OF EMBODIMENT

Hereinafter, an embodiment of an acoustic conversion apparatus and sound output equipment of the present technique will be described with reference to the accompanying drawings.

In the following description, a direction in which sound is output is set as an upward direction to illustrate front, back, up, down, left, and right directions. Note that the front, back, up, down, left, and right directions illustrated below are for the convenience of the description, and the directions are not limited to these in the implementation of the present technique.

<Overall Configuration>

Figure 1:
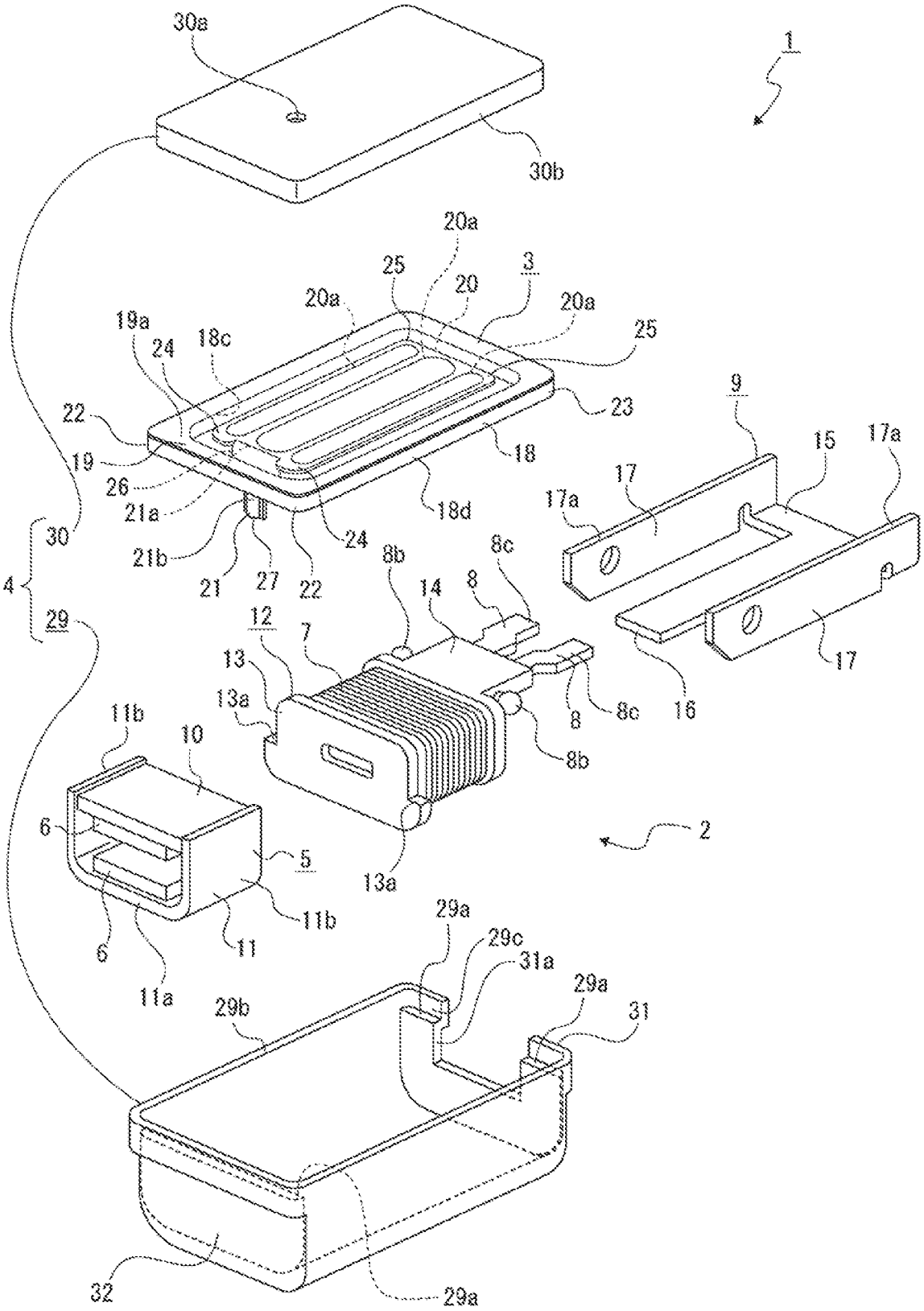
FIG. 1 depicts an embodiment of an acoustic conversion apparatus and sound output equipment of the present technique along with FIGS. 2 to 18.
Figure 2:
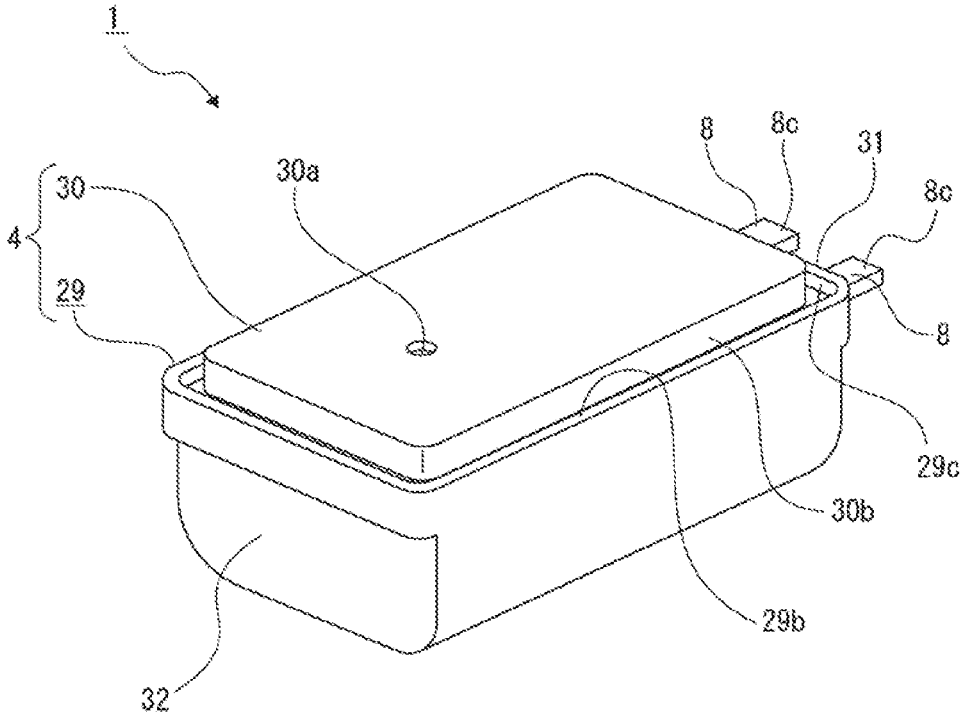
FIG. 2 is an enlarged perspective view of the acoustic conversion apparatus.
Figure 3:
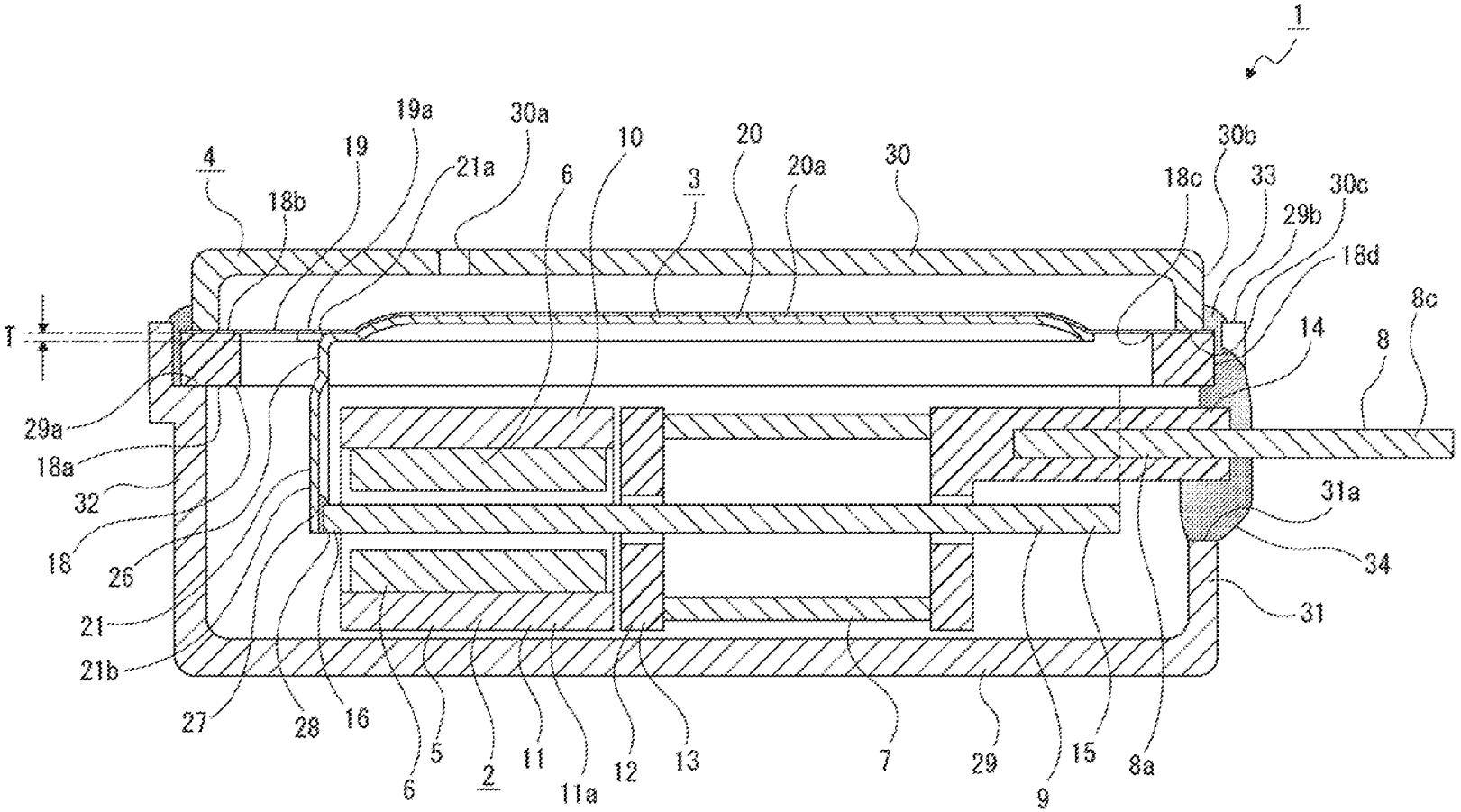
FIG. 3 is an enlarged cross-sectional view of the acoustic conversion apparatus.

An acoustic conversion apparatus 1 includes a drive unit 2, a vibration plate unit 3, and a storage unit 4 (See FIGS. 1 to 3). The acoustic conversion apparatus 1 is incorporated and used in various sound output equipment, such as a headphone, an earphone, and a hearing aid.

The drive unit 2 includes a yoke 5, a pair of magnets 6 and 6, a coil 7, connection terminals 8 and 8, and an armature 9 (see FIGS. 1 and 3).

The yoke 5 is formed by a magnetic material and is constituted by combining a planar first member 10 facing the up and down direction and a U-shaped second member 11 opening upward. The second member 11 is constituted by a bottom surface portion 11*a* facing the up and down direction and side surface portions 11*b* and 11*b* individually protruding upward from both left and right end portions of the bottom surface portion 11*a*.

Both left and right side surfaces of the first member 10 are individually attached to inner surfaces of the side surface portions 11*b* and 11*b* of the second member 11 by welding, bonding, or the like. The yoke 5 is formed by combining the first member 10 and the second member 11 and formed in a rectangular cylindrical shape penetrating forward and backward.

The magnets 6 and 6 are isolated in the up and down direction and arranged to face each other. The poles of the sides facing each other are set to different poles. The magnet 6 positioned above is attached to a lower surface of the first member 10, and the magnet 6 positioned below is attached to an upper surface of the bottom surface portion 11*a* in the second member 11 (see FIG. 4).

The coil 7 is wound on a coil bobbin 12 (see FIGS. 1 and 3). The coil bobbin 12 includes a coil winding portion 13 opened upward and downward and penetrating forward and backward, and a terminal holding portion 14 protruding to the back from an upper end portion on a back surface of the coil winding portion 13. Receiving projections 13*a* and 13*a* protruding to the left and right are provided on a front end portion of the coil winding portion 13.

The coil 7 is wound on the coil winding portion 13, with an axial direction set to the front and back direction.

The connection terminals 8 and 8 are lined up on the left and right and held by the terminal holding portion 14 of the coil bobbin 12. The connection terminal 8 is constituted by a buried portion 8*a* buried and held by the terminal holding portion 14, a coil connection portion 8*b* protruding to the side from the buried portion 8*a*, and a terminal portion 8*c* protruding to the back from the buried portion 8*a*. The coil connection portion 8*b* protrudes to the side from a side surface of the terminal holding portion 14, and the terminal portion 8*c* protrudes to the back from a back surface of the terminal holding portion 14.

Both end portions of the coil 7 are individually connected to the coil connection portions 8*b* and 8*b* of the connection terminals 8 and 8. The terminal portions 8*c* and 8*c* are connected to an input signal source not depicted. Therefore, an input signal is supplied from the input signal source to the coil 7 through the connection terminals 8 and 8.

The armature 9 is constituted by integrally forming each part by a magnetic metal material. The armature 9 is constituted by integrally forming a base section 15 formed in a horizontally long shape facing the up and down direction, a vibration portion 16 protruding to the front from the center of the base section 15 in the left and right direction, and fixed portions 17 and 17 individually protruding to the front from both left and right end portions of the base section 15. The vibration portion 16 is formed in a plate shape facing the up and down direction, and the fixed portions 17 and 17 are formed in a plate shape facing the left and right direction. Upper surfaces of the fixed portions 17 and 17 are individually formed as fixing surfaces 17*a* and 17*a*.

Figure 5:
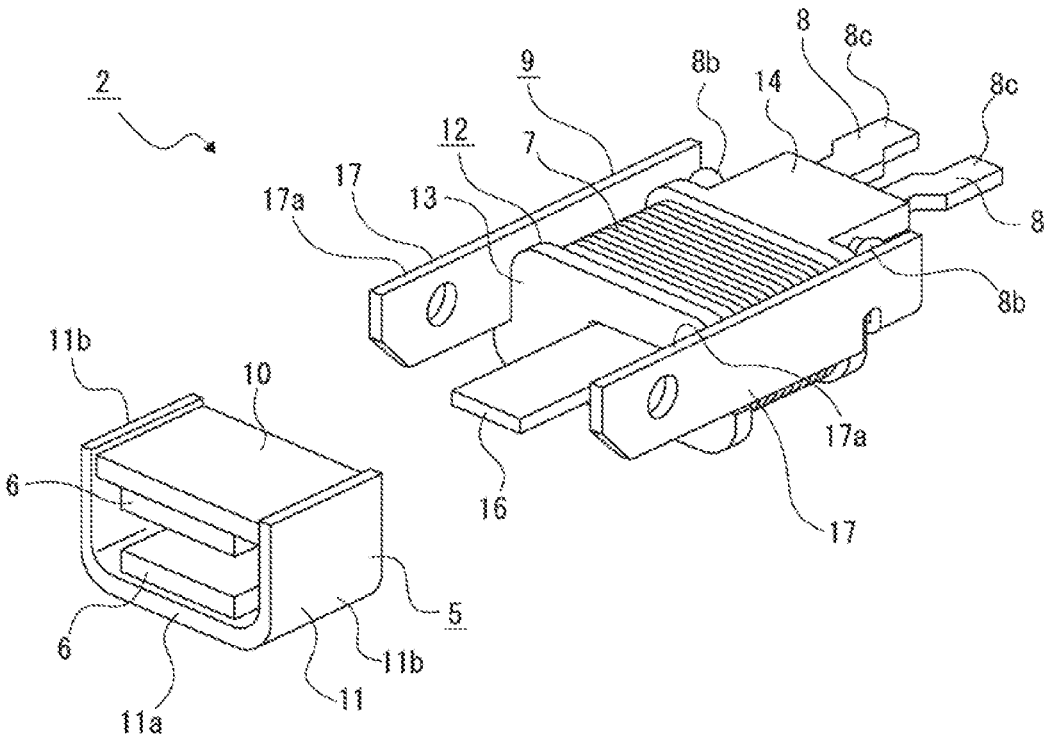
FIG. 5 is an enlarged exploded perspective view of the drive unit.

The coil bobbin 12 is attached to the armature 9 by bonding the coil 7 to inner surfaces of the fixed portions 17 and 17 (see FIGS. 3 and 5).

In the state in which the coil bobbin 12 is attached to the armature 9, the vibration portion 16 penetrates through the coil winding portion 13 of the coil bobbin 12, and part of the vibration portion 16 protrudes to the front from the coil 7 (see FIG. 3). In this case, intermediate portions of the fixed portions 17 and 17 are individually mounted on the receiving projections 13*a* and 13*a* of the coil bobbin 12, and the armature 9 is positioned relative to the coil bobbin 12 (see FIG. 5).

In the acoustic conversion apparatus 1, the fixed portions 17 and 17, to which the coil 7 is attached, and the vibration portion 16 penetrating through the coil bobbin 12 are all provided on the armature 9. Therefore, the position of the vibration portion 16 relative to the coil bobbin 12 and the coil 7 can be secured with a high accuracy, and the position accuracy of the vibration portion 16 relative to the coil bobbin 12 and the coil 7 can be improved.

Figure 4:
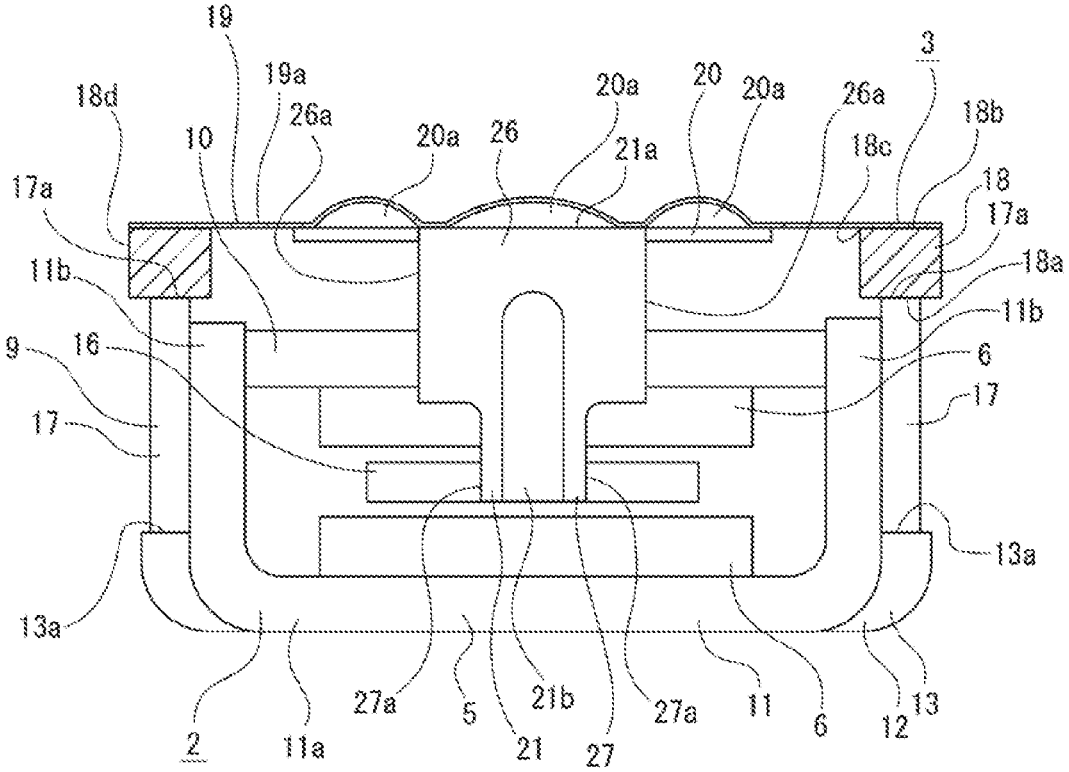
FIG. 4 is an enlarged front view depicting a state in which a drive unit and a vibration plate unit are combined.
Figure 6:
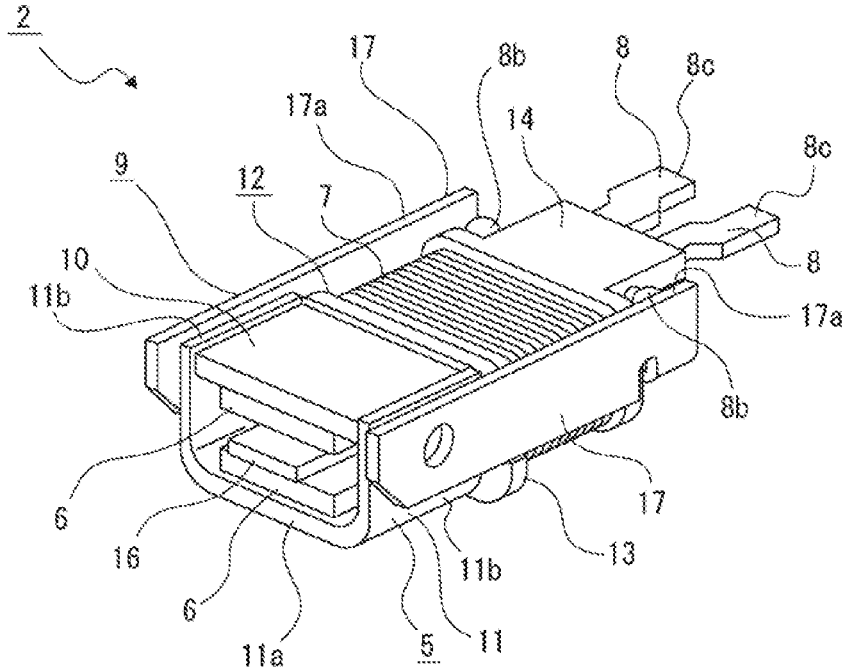
FIG. 6 is an enlarged perspective view of the drive unit.

In the armature 9, the fixed portions 17 and 17 are individually fixed to outer surfaces of the side surface portions 11*b* and 11*b* of the yoke 5 by bonding, welding, or the like in the state in which the coil bobbin 12 is attached to the armature 9 (see FIGS. 4 and 6).

In the state in which the armature 9 is fixed to the yoke 5, the fixing surfaces 17*a* and 17*a* of the armature 9 are individually positioned slightly above upper surfaces of the side surface portions 11*b* and 11*b* of the yoke 5 (see FIG. 4).

The vibration plate unit 3 is constituted by a holding frame 18, a film 19, a vibration plate 20, and a transmission beam 21 (see FIGS. 1 and 3). A resin film or a paper film is used for the film 19, for example.

The holding frame 18 is formed by, for example, a metal material and formed in a substantially rectangular frame shape, in which the length in the front and back direction is longer than the length in the left and right direction, and the width in the left and right direction is substantially the same as the width of the armature 9 in the left and right direction. A lower surface of the holding frame 18 is a first joint surface 18*a*, and an upper surface is a second joint surface 18*b*.

The size of the film 19 is the same as the outer shape of the holding frame 18, and the film 19 is pasted on the second joint surface 18*b* of the holding frame 18 by bonding or the like so as to close an opening 18*c* of the holding frame 18 (see FIG. 3).

Figure 7:
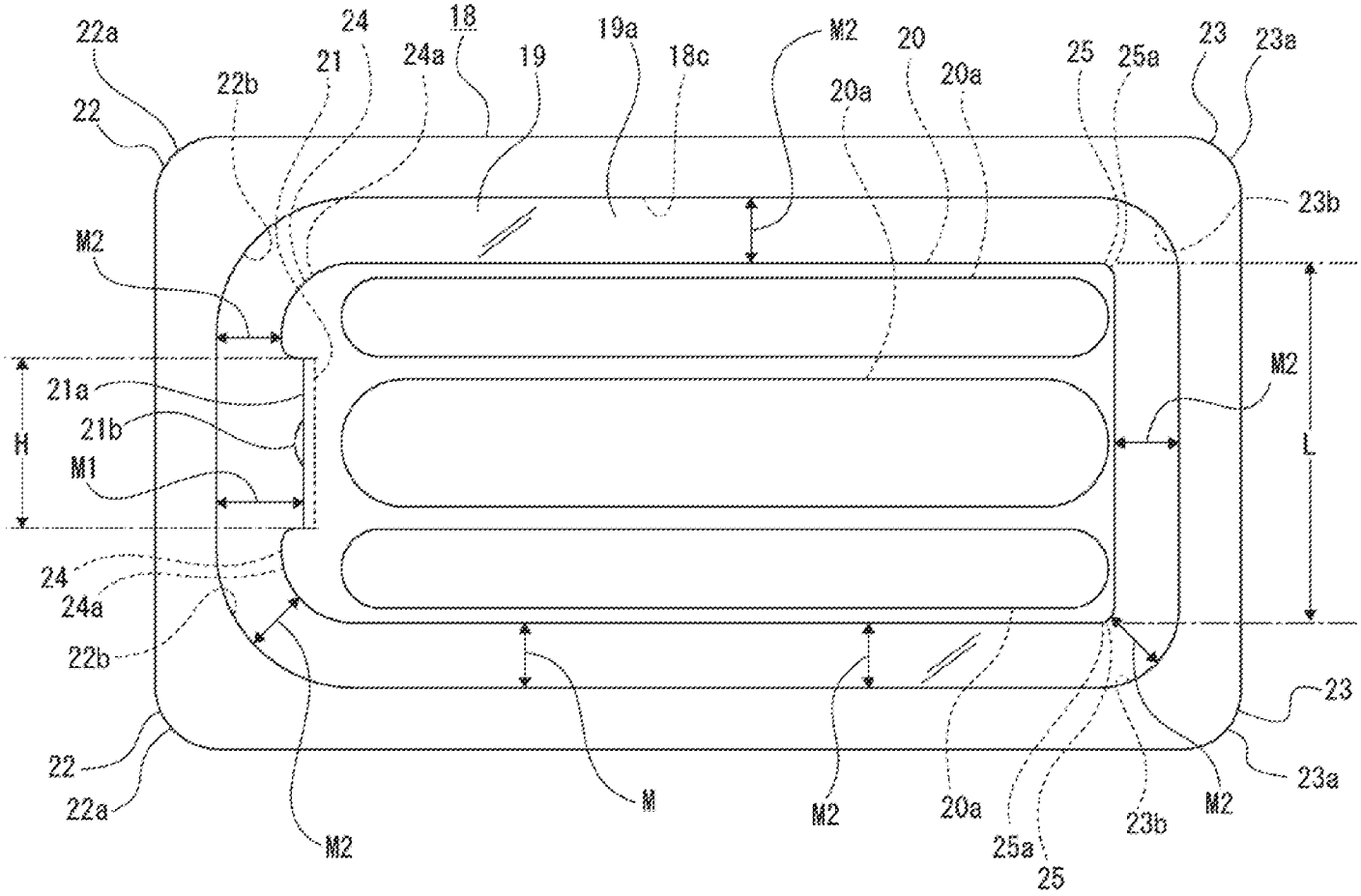
FIG. 7 is an enlarged plan view of the vibration plate unit.

The holding frame 18 is formed in a shape such that four corner portions 22, 22, 23, and 23 are roundish and not angular (see FIG. 7). Outer circumferences 22*a* and 22*a* of the corner portions 22 and 22 on the front side and outer circumferences 23*a* and 23*a* of the corner portions 23 and 23 on the back side are formed in an arc shape with the same curvature. In addition, inner circumferences 22*b* and 22*b* of the corner portions 22 and 22 on the front side are formed in an arc shape with a larger curvature than the outer circumferences 22*a* and 22*a*, and inner circumferences 23*b* and 23*b* of the corner portions 23 and 23 on the back side are formed in an arch shape with a larger curvature than the outer circumferences 23*a* and 23*a*.

The vibration plate 20 is formed in a substantially rectangular shape with the outer shape slightly smaller than the inner shape of the holding frame 18. Vibration generated in the vibration portion 16 of the armature 9 is transmitted to the vibration plate 20 through the transmission beam 21.

The vibration plate 20 is formed by a thin metal material, such as aluminum and stainless steel. A thickness T (see FIG. 3) of the vibration plate 20 is, for example, approximately 50 μm, and a width L (see FIG. 7) in the left and right direction is, for example, approximately 2.3 mm.

The vibration plate 20 can be formed by aluminum to reduce the weight. On the other hand, the vibration plate 20 can be formed by stainless steel to increase the strength to improve the transmission efficiency of the vibration from the vibration portion 16 to the vibration plate 20.

Figure 8:
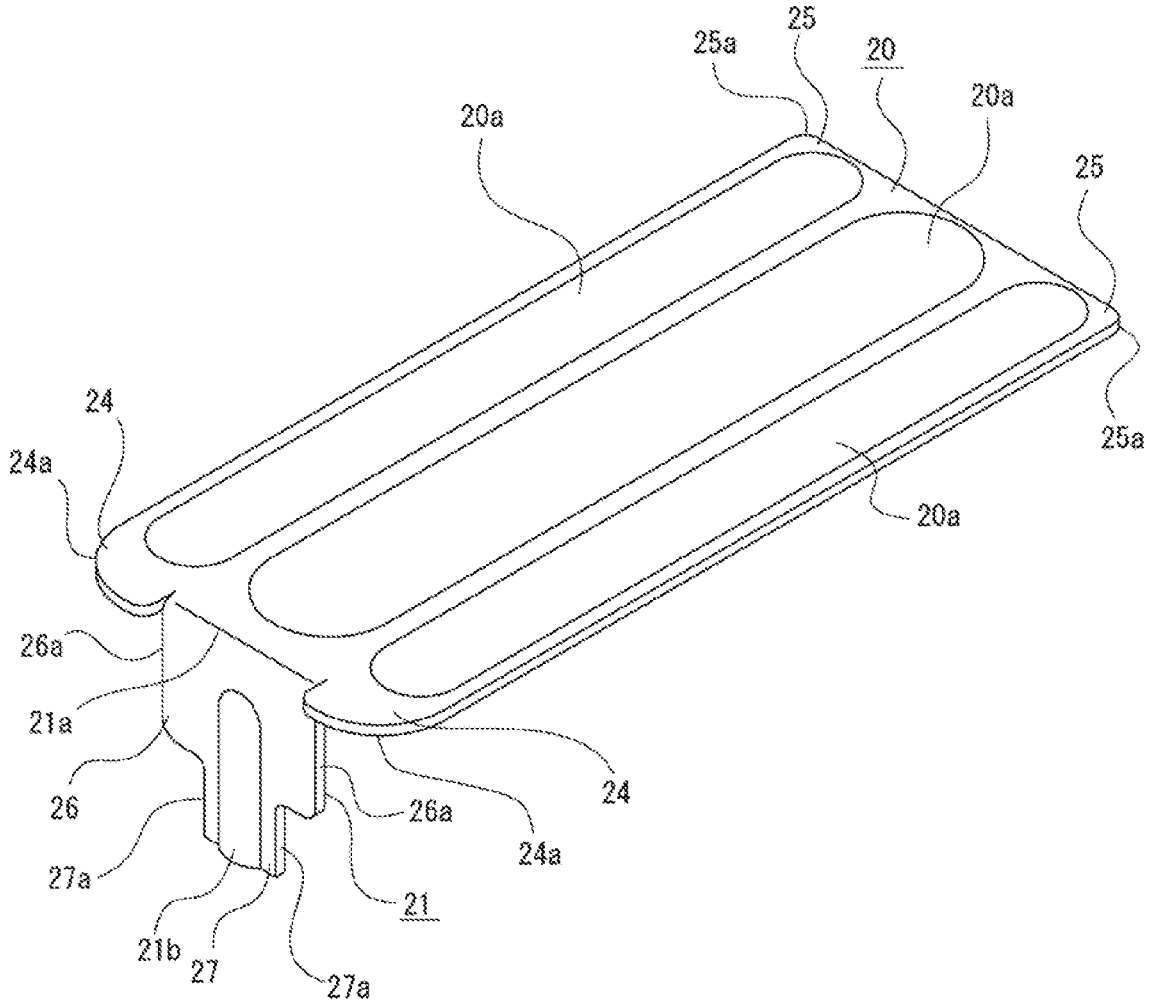
FIG. 8 is an enlarged perspective view of a vibration plate and a transmission beam.

Reinforcing ribs 20*a*, 20*a*, and 20*a* extending forward and backward and isolated to the left and right are provided on the vibration plate 20, and the reinforcing ribs 20*a*, 20*a*, and 20*a* are formed in a shape hammered out upward or downward (see FIG. 8).

The vibration plate 20 is, for example, pasted to the film 19 from below (see FIG. 3).

The vibration plate 20 is formed in a shape such that four corner portions 24, 24, 25, and 25 are roundish and not angular (see FIG. 7). Outer circumferences 24*a* and 24*a* of the corner portions 24 and 24 on the front side are individually formed in an arc shape with a curvature larger than the inner circumferences 22*b* and 22*b* of the corner portions 22 and 22 on the front side in the holding frame 18, and the centers of the arcs of the outer circumferences 24*a* and 24*a* and the centers of the arcs of the inner circumferences 22*b* and 22*b* coincide with each other. Furthermore, outer circumferences 25*a* and 25*a* of the corner portions 25 and 25 on the back side are individually formed in an arc shape with a curvature larger than the inner circumferences 23*b* and 23*b* of the corner portions 23 and 23 on the back side in the holding frame 18, and the centers of the arcs of the outer circumferences 25*a* and 25*a* and the centers of the arcs of the inner circumferences 23*b* and 23*b* coincide with each other.

In this way, in the vibration plate unit 3, the outer shape of the vibration plate 20 is slightly smaller than the inner shape of the holding frame 18. The centers of the arcs of the outer circumferences 24*a* and 24*a* and the centers of the arcs of the inner circumferences 22*b* and 22*b* coincide with each other, and the centers of the arcs of the outer circumferences 25*a* and 25*a* and the centers of the arcs of the inner circumferences 23*b* and 23*b* coincide with each other.

Therefore, a distance M between the inner shape of the holding frame 18 and the outer shape of the vibration plate 20 is a constant size in the entire circumference except for part of the entire circumference. Note that as described later, the transmission beam 21 is formed by bending the transmission beam 21 from the vibration plate 20, and the bent part is positioned inside of the other part of the outer circumference in the vibration plate 20. Therefore, a distance M1 between the bent part and the inner circumference of the vibration plate 20 is larger than a distance M2 between the part that is not bent and the inner circumference of the vibration plate 20. However, the bent position of the transmission beam 21 bent from the vibration plate 20 may be changed to set the distance M1 to the same size as the distance M2 and set the distance M to the same size throughout the entire circumference.

The transmission beam 21 is formed integrally with the vibration plate 20, and for example, the transmission beam 21 is formed by bending the transmission beam 21 downward from the vibration plate 20 (see FIG. 8). The transmission beam 21 is formed by bending the transmission beam 21 downward from the center in the left and right direction at the front edge of the vibration plate 20. A bent part 21*a* formed by bending the transmission beam 21 from the vibration plate 20 is positioned inside of the other part of the outer circumference in the vibration plate 20. A width H of the bent part 21*a* in the left and right direction is, for example, approximately 1.1 mm.

Note that the transmission beam 21 may be formed separately from the vibration plate 20 and may be attached to the vibration plate 20 by bonding or welding. However, to improve the strength in a case where the transmission beam 21 is formed separately from the vibration plate 20, it is desirable that the transmission beam 21 be attached to the vibration plate 20 by welding.

Furthermore, the transmission beam 21 may be formed by, for example, a metal column in a round shaft shape with a diameter of approximately 1 mm.

The transmission beam 21 is formed in a plate shape facing the front and back direction and is constituted by a base portion 26 continuous with the vibration plate 20 and a coupling portion 27 continuous with a lower end of the base portion 26. The width of the base portion 26 in the left and right direction is constant, and the base portion 26 is formed in a straight line with side edges 26*a* and 26*a* extending up and down. The width of the coupling portion 27 in the left and right direction is constant, and the width in the left and right direction is smaller than the width of the base portion 26 in the left and right direction. The coupling portion 27 is formed in a straight line with side edges 27*a* and 27*a* extending up and down, and the side edges 27*a* and 27*a* are individually positioned inside of the side edges 26*a* and 26*a* of the base portion 26.

A rib 21*b* is formed on the transmission beam 21 from a lower end to a position substantially at the center of the base portion 26 in the up and down direction. The rib 21*b* is formed in a shape hammered out to the front or to the back.

As described above, in the acoustic conversion apparatus 1, the transmission beam 21 includes the base portion 26 continuous with the vibration plate 20, and the coupling portion 27 continuous with the base portion 26 and coupled to the vibration portion 16, and the width of the base portion 26 is larger than the width of the coupling portion 27.

Therefore, the width of the part (bent part 21*a*) of the transmission beam 21 continuous with the vibration plate 20 is large, and the strength of the transmission beam 21 is high. This can improve the transmission efficiency of the vibration from the vibration portion 16 to the vibration plate 20.

In addition, since the width of the base portion 26 and the width of the coupling portion 27 are both constant, the base portion 26 and the coupling portion 27 have the same strengths regardless of the positions of the base portion 26 and the coupling portion 27 in the continuous direction (up and down direction) of the base portion 26 and the coupling portion 27. This can further improve the transmission efficiency of the vibration from the vibration portion 16 to the vibration plate 20.

Furthermore, since the reinforcing ribs 20*a*, 20*a*, and 20*a* are formed on the vibration plate 20, the strength of the vibration plate 20 is high, and the curvature of the vibration plate 20 is reduced during the vibration. The vibration plate 20 can easily make translational motion for displacement in the thickness direction, and a favorable vibration state of the vibration plate 20 can be secured.

Furthermore, since the rib 21*b* is formed on the transmission beam 21, the strength of the transmission beam 21 is high, and the curvature of the transmission beam 21 is reduced during the vibration. This can further improve the transmission efficiency of the vibration from the vibration portion 16 to the vibration plate 20.

Figure 9:
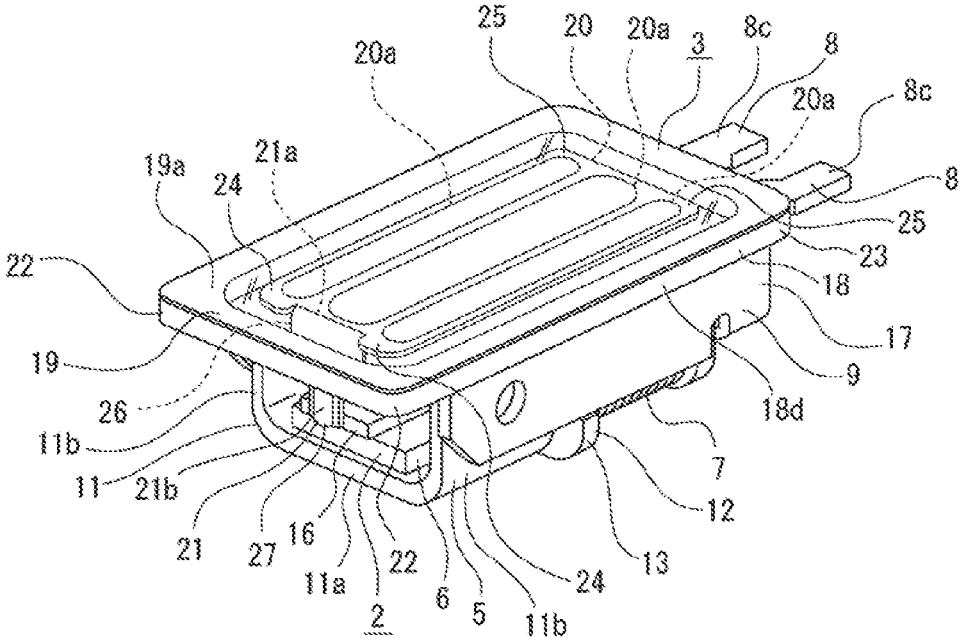
FIG. 9 is an enlarged perspective view depicting a state in which the vibration plate unit is fixed to the drive unit.

The vibration plate unit 3 is fixed to the drive unit 2 from above by, for example, bonding or laser welding (see FIGS. 3 and 9). The vibration plate unit 3 is fixed by joining the first joint surface 18*a* of the holding frame 18 to the fixing surfaces 17*a* and 17*a* formed on the fixed portions 17 and 17 of the armature 9.

When the drive unit 2 is fixed to the vibration plate unit 3, a lower end portion of the transmission beam 21 is fixed by an adhesive 28 to a front end portion of the vibration portion 16 in the armature 9 (see FIGS. 3 and 4).

As described above, since the transmission beam 21 is formed by bending the transmission beam 21 from the vibration plate 20, the transmission beam 21 and the vibration plate 20 are integrally formed. The vibration plate 20 and the armature 9 are coupled through the transmission beam 21 just by fixing the lower end portion of the transmission beam 21 to the vibration portion 16, and this can improve the work efficiency in the coupling work of the vibration plate 20, the transmission beam 21, and the armature 9.

In addition, since the transmission beam 21 is formed by bending the transmission beam 21 from the vibration plate 20, the transmission beam 21 and the vibration plate 20 are integrally formed, and an upper end portion of the transmission beam 21 does not have to be attached to the vibration plate 20 in the state in which the lower end portion of the transmission beam 21 is fixed to the vibration portion 16 of the armature 9. Therefore, the upper end portion of the transmission beam 21 does not have to be blindly attached to the vibration plate 20. Deviation of the coupling position of the transmission beam 21 relative to the vibration plate 20, deformation of the transmission beam 21, bending of the transmission beam 21 relative to the vibration plate 20, and the like do not occur, and the yield can be improved.

Furthermore, since the transmission beam 21 and the vibration plate 20 are integrally formed, the number of parts in the acoustic conversion apparatus 1 can be reduced, and the transmission efficiency of the vibration from the vibration portion 16 to the vibration plate 20 can be improved.

The storage unit 4 is constituted by a box-shaped case body 29 opened upward and a shallow box-shaped cover body 30 opened downward (see FIGS. 1 to 3).

In the case body 29, an insertion cutout 31*a* opened upward is formed on an upper end portion of a back surface portion 31. Mounting stepped surfaces 29*a*, 29*a*, and 29*a* facing upward are formed on inner surface sides of upper end portions of a front surface portion 32 and the back surface portion 31 of the case body 29, individually.

A sound output hole 30*a* is formed on the cover body 30. Note that the sound output hole may be formed on the case body 29.

As described above, the drive unit 2 and the vibration plate unit 3 are combined by joining the first joint surface 18*a* of the holding frame 18 to the fixing surfaces 17*a* and 17*a* of the armature 9 and attaching the lower end portion of the transmission beam 21 to the front end portion of the vibration portion 16 in the armature 9 by the adhesive 28.

Figure 10:
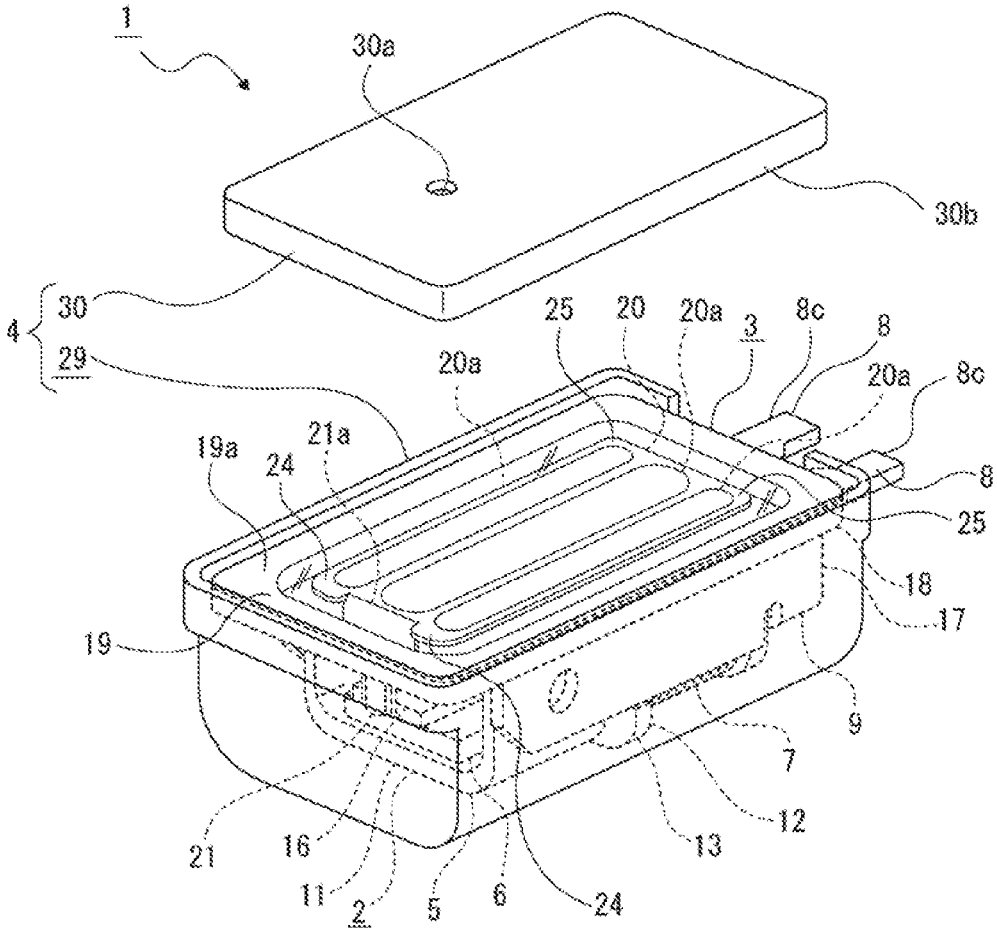
FIG. 10 is an exploded perspective view depicting a state in which the drive unit and the vibration plate unit are housed in a case body.

The drive unit 2 and the vibration plate unit 3 combined in this way are stored in the case body 29 from the above (see FIG. 10).

The vibration plate unit 3 stored in the case body 29 is positioned by mounting both front and back end portions of the holding frame 18 on the mounting stepped surfaces 29*a*, 29*a*, and 29*a* of the case body 29, individually (see FIG. 3). Here, a predetermined gap is formed between a lower surface of the drive unit 2 and an upper surface of a bottom surface portion in the case body 29.

Figure 11:
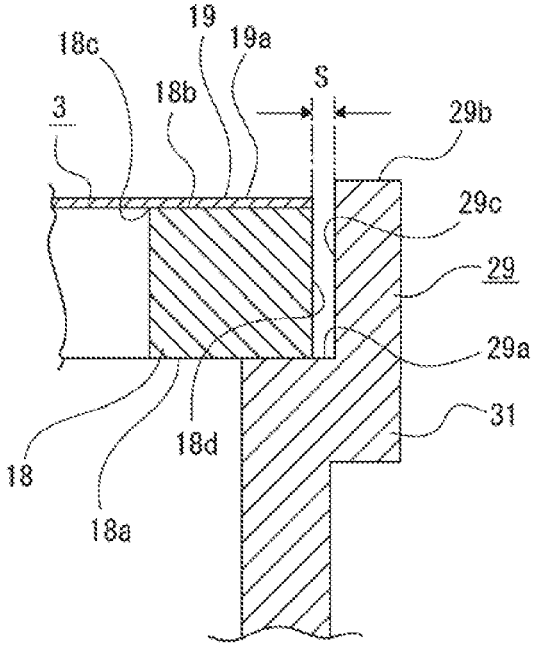
FIG. 11 is an enlarged cross-sectional view depicting a state before a first sealing agent is loaded on a holding frame of the vibration plate unit.

In the state in which the drive unit 2 and the vibration plate unit 3 are stored in the case body 29, the second joint surface 18*b* of the holding frame 18 is positioned slightly downward, just inside of an upper end surface 29*b* of the case body 29 (see FIG. 11). In this case, a space S is formed between an outer surface 18*d* of the holding frame 18 and an inner surface 29*c* of the case body 29.

In addition, in the state in which the drive unit 2 and the vibration plate unit 3 are stored in the case body 29, part of each of the connection terminals 8 and 8 protrudes to the back from the insertion cutout 31*a* of the case body 29 (see FIGS. 3 and 10).

Figure 12:
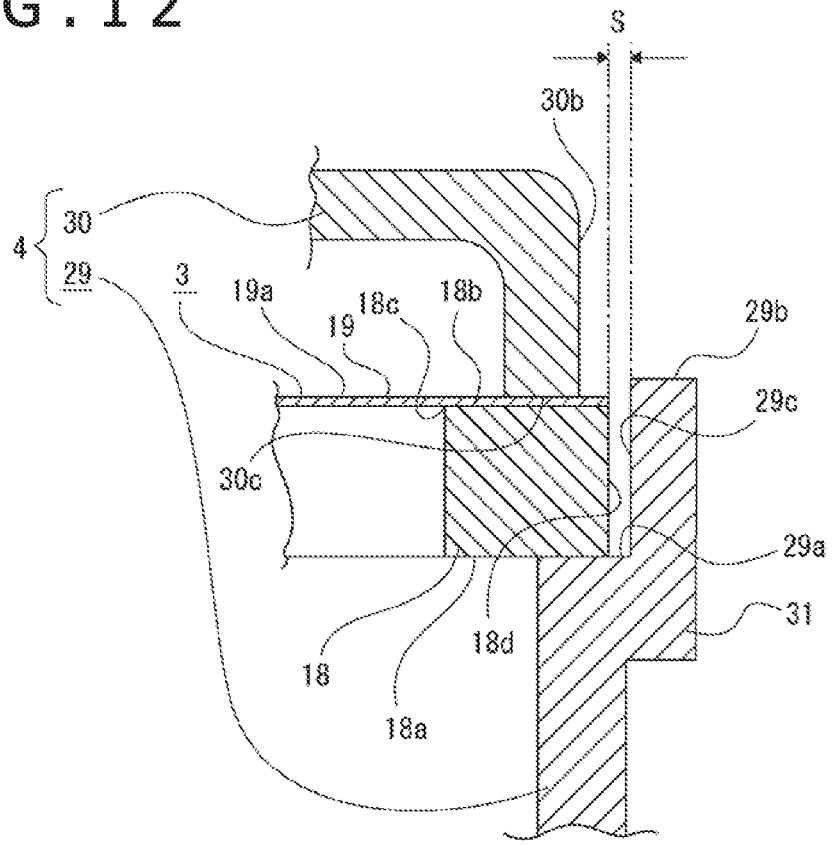
FIG. 12 is an enlarged cross-sectional view depicting a state in which a cover body is mounted on a film.

The cover body 30 is mounted on an outer circumference portion of an upper surface 19*a* in the film 19 (see FIG. 12).

Figure 13:
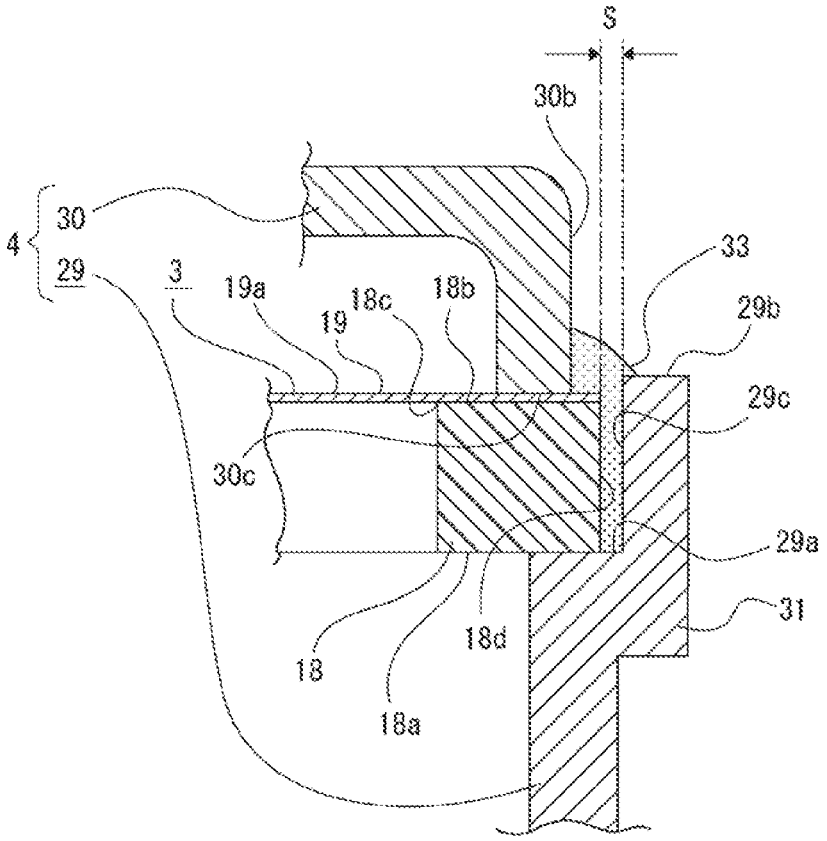
FIG. 13 is an enlarged cross-sectional view depicting a state in which a space is filled with the first sealing agent loaded on the holding frame of the vibration plate unit.

In the state in which the cover body 30 is mounted on the upper surface 19*a*, a first sealing agent 33 is loaded on an outer surface side of the cover body 30 (see FIG. 13). The first sealing agent 33 also has an adhesive effect. The first sealing agent 33 enters between the outer surface 18*d* of the holding frame 18 and the inner surface 29*c* of the case body 29 and between an outer surface 30*b* of the cover body 30 and the inner surface 29*c* of the case body 29. The space S is sealed, and the cover body 30 is fixed to the case body 29.

In addition, a second sealing agent (adhesive) 34 is applied to a space between an opening edge of the insertion cutout 31*a* in the case body 29 and the connection terminals 8 and 8 to perform sealing and bonding (see FIG. 3).

As described above, in the acoustic conversion apparatus 1, the drive unit 2 and the vibration plate unit 3 are stored in the storage unit 4 including the case body 29 and the cover body 30, in which the sound output hole 30*a* is formed on the storage unit 4. Therefore, the drive unit 2 and the vibration plate unit 3 are protected by the storage unit 4, and damage or breakage of the drive unit 2 and the vibration plate unit 3 can be prevented.

<Acoustic Characteristics>

In the acoustic conversion apparatus 1, when a current is supplied to the coil 7, the vibration portion 16 of the armature 9 positioned between the pair of magnets 6 and 6 is magnetized, and the polarity of the vibration portion 16 is repeatedly changed at positions facing the magnets 6 and 6. As the polarity is repeatedly changed, micro-vibration is generated in the vibration portion 16, and the generated vibration is transmitted from the transmission beam 21 to the vibration plate 20. The transmitted vibration is amplified by the vibration plate 20 and converted into sound, and the sound is output from the sound output hole 30*a* of the cover body 30.

Here, a favorable vibration state of the vibration plate 20 needs to be secured to improve acoustic characteristics by reducing variations of the sound pressure in the frequency region of the output sound. Particularly, to improve the acoustic characteristics in a low frequency region, it is desirable that the vibration plate 20 be displaced in the thickness direction to make translational motion.

The acoustic conversion apparatus 1 is configured such that the distance M is formed between the entire circumference of the outer circumference of the vibration plate 20 and the entire circumference of the inner circumference of the holding frame 18 as described above.

Figure 14:
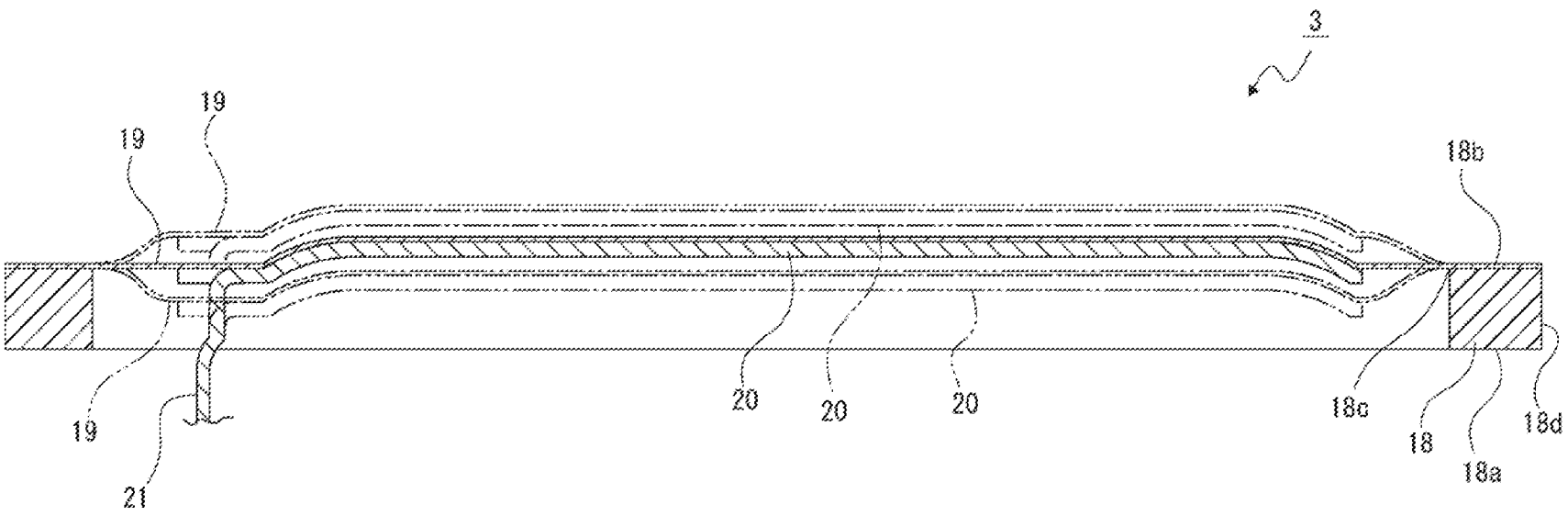
FIG. 14 is a conceptual diagram depicting a state in which the vibration plate vibrates and makes translational motion.

Therefore, the vibration plate 20 is held by the film 19 inside of the inner circumference of the holding frame 18, and the vibration plate 20 makes translational motion in the thickness direction when the vibration is transmitted from the vibration portion 16 to the vibration plate 20 through the transmission beam 21 (see FIG. 14).

In this way, the distance M is formed on the entire circumference between the vibration plate 20 and the holding frame 18 to cause the vibration plate 20 to make translational motion in the acoustic conversion apparatus 1. As a result, the vibration plate 20 can make translational motion without increasing the amplitude of the drive portion 16 or enlarging the area of the vibration plate 20.

Therefore, the acoustic characteristics, particularly, the acoustic characteristics in the low frequency region, can be improved without increasing the manufacturing cost or increasing the size.

Hereinafter, results of measurement of the acoustic characteristics will be described (see FIG. 15).

Figure 15:
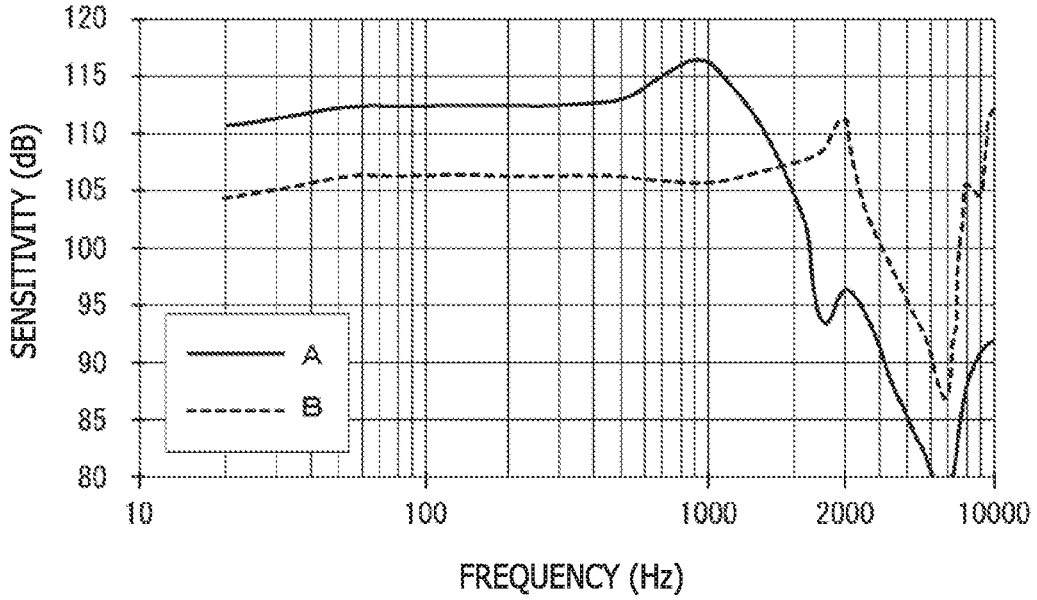
FIG. 15 is a graphic diagram depicting results of measurement of acoustic characteristics.

FIG. 15 is a graphic diagram depicting the frequency (Hz) on the horizontal axis and depicting the sensitivity (dB) on the vertical axis.

In FIG. 15, A indicates the frequency characteristics of the acoustic conversion apparatus 1 forming the distance M on the entire circumference between the vibration plate 20 and the holding frame 18, and B indicates the frequency characteristics of an acoustic conversion apparatus (acoustic conversion apparatus 1A described later), in which one end portion (back end portion) of a vibration plate is fixed to a holding frame by bonding, and the vibration plate is displaced in a cantilever state with the one end portion as a fulcrum.

By comparing A and B of FIG. 15, it can be understood that the sensitivity of the acoustic conversion apparatus 1 is higher than the sensitivity of the conventional acoustic conversion apparatus in a frequency region below approximately 2000 Hz.

Based on the measurement results described above, it is confirmed that the sensitivity of the acoustic conversion apparatus 1 is high in the low frequency region, and the acoustic characteristics are improved.

Particularly, since the size of the distance M is constant throughout the entire circumference in the acoustic conversion apparatus 1 as described above, the distance between the outer circumference of the vibration plate 20 and the inner circumference of the holding frame 18 is constant, and stable balance of the vibration plate 20 with respect to the holding frame 18 is secured. The vibration plate 20 can more easily make translational motion, and a favorable vibration state of the vibration plate 20 can be secured.

In addition, since the inner circumferences 22*b*, 22*b*, 23*b*, and 23*b* in the corner portions 22, 22, 23, and 23 of the holding frame 18 are formed in curved shapes, the stress is not concentrated on the corner portions 22, 22, 23, and 23 of the holding frame 18 when the vibration plate 20 is vibrated, and a more favorable vibration state of the vibration plate 20 can be secured.

Furthermore, since the outer circumferences 24*a*, 24*a*, 25*a*, and 25*a* in the corner portions 24, 24, 25, and 25 of the vibration plate 20 are also formed in curved shapes, the stress is not concentrated on the corner portions 24, 24, 25, and 25 of the vibration plate 20 when the vibration plate 20 is vibrated, and a more favorable vibration state of the vibration plate 20 can be secured.

<Sound Output Equipment>

As depicted in FIG. 15, sufficient sensitivity may not be secured in a high frequency region in the acoustic conversion apparatus 1.

Figure 16:
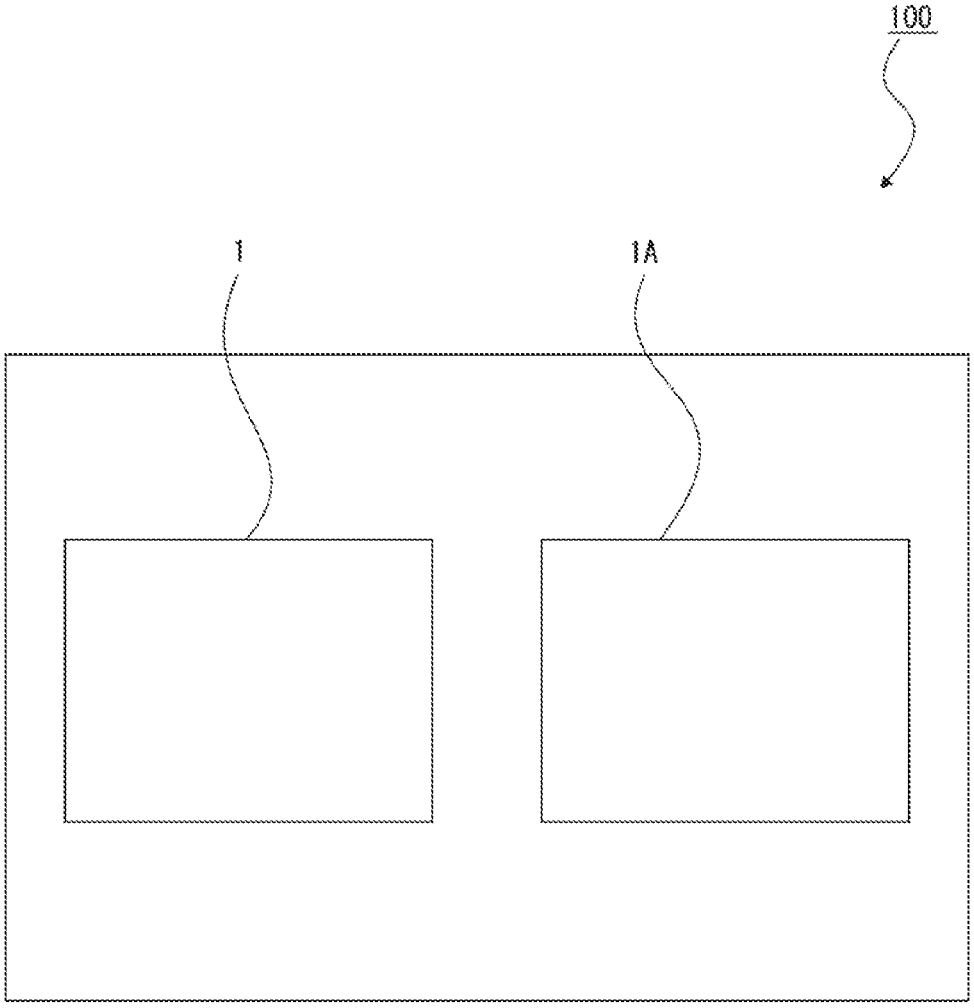
FIG. 16 is a conceptual diagram of the sound output equipment.

In this case, for example, an acoustic conversion apparatus 1A for high-pitched sound that can secure high acoustic characteristics in the high frequency region may be incorporated and used in sound output equipment 100, such as a headphone, an earphone, and a hearing aid (see FIG. 16) in addition to the acoustic conversion apparatus 1. The acoustic conversion apparatus 1 is used as a first acoustic conversion apparatus, and the acoustic conversion apparatus 1A is used as a second acoustic conversion apparatus. Note that the acoustic conversion apparatus 1A may be used as an apparatus corresponding to a full range.

Figure 17:
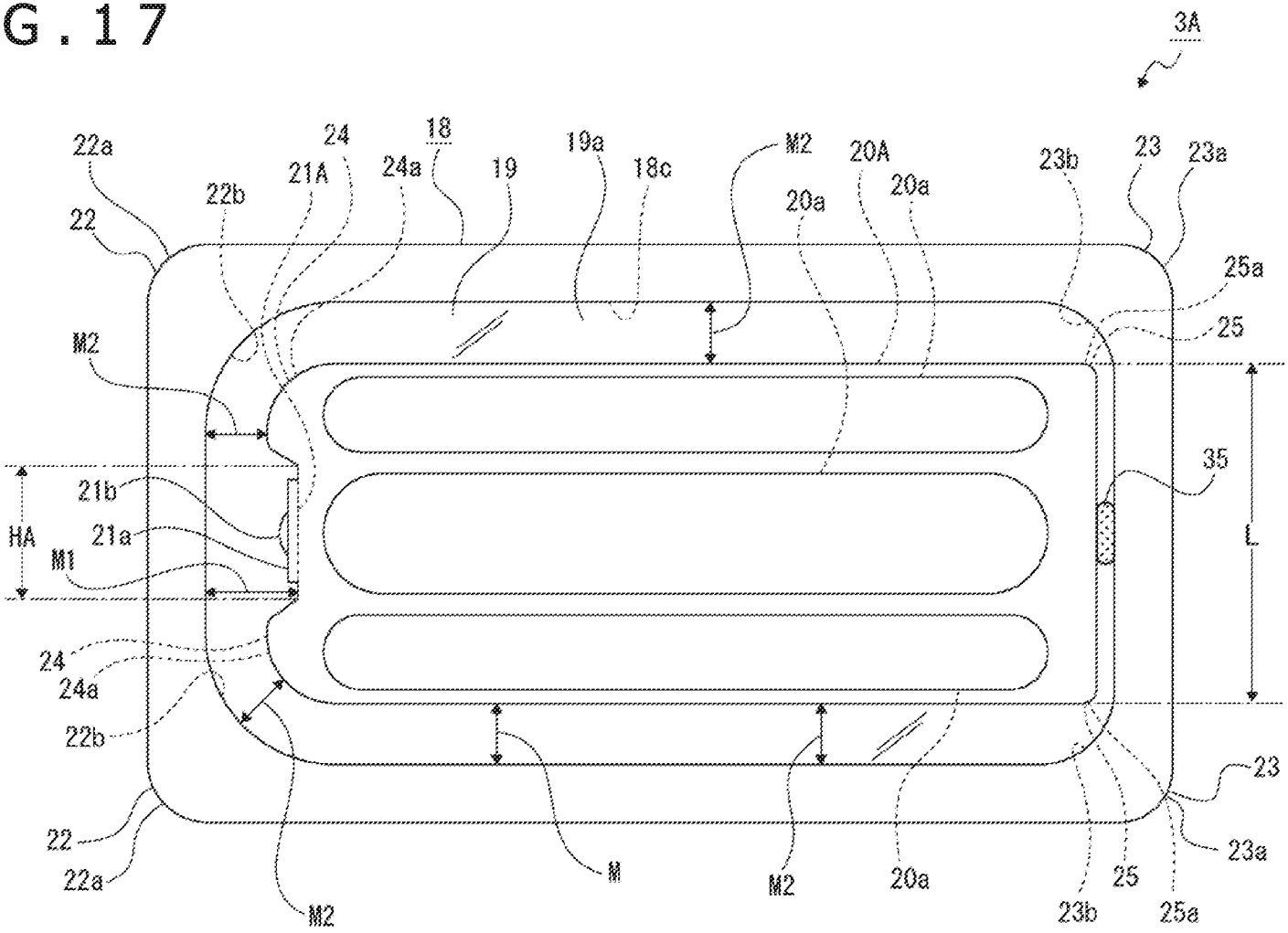
FIG. 17 is an enlarged plan view of a vibration plate unit in a second acoustic conversion apparatus.
Figure 18:
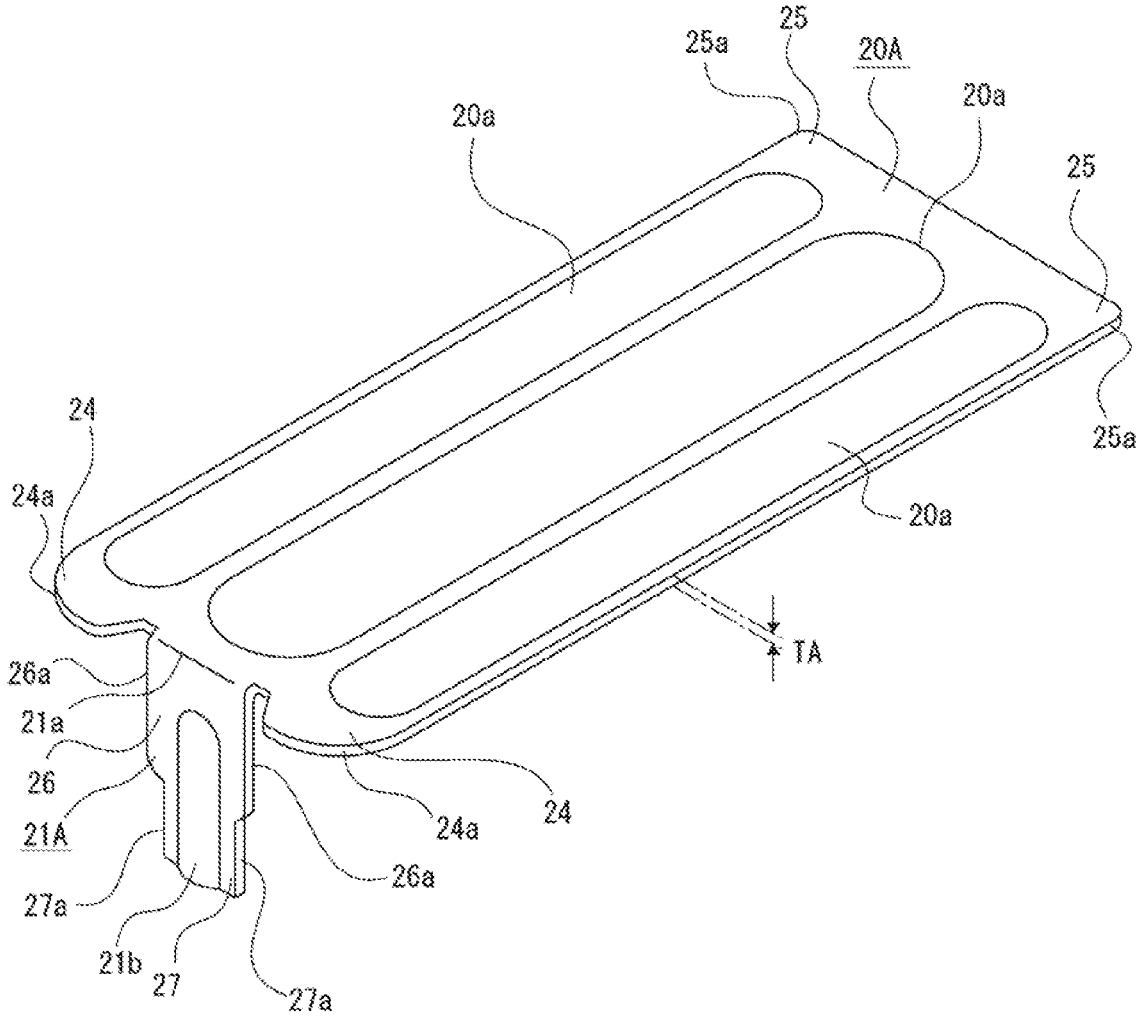
FIG. 18 is an enlarged perspective view of a vibration plate and a transmission beam in the second acoustic conversion apparatus.

The acoustic conversion apparatus 1A is constituted by, for example, the drive unit 2, a vibration plate unit 3A, and the storage unit 4 and includes the vibration plate unit 3A with a configuration partially different from the vibration plate unit 3 of the acoustic conversion apparatus 1 (see FIGS. 17 and 18). Note that only part of the configuration of the vibration plate unit 3A in the acoustic conversion apparatus 1A is different from the vibration plate unit 3A, and only the different configuration will be described in detail in the following description of the acoustic conversion apparatus 1A.

The vibration plate unit 3A is constituted by the holding frame 18, the film 19, a vibration plate 20A, and a transmission beam 21A.

Compared to the vibration plate 20, the width of the vibration plate 20A in the left and right direction is the same. However, the length in the front and back direction is long, and a thickness TA is thin. The thickness TA of the vibration plate 20 is, for example, approximately 30 μm which is thinner than the thickness T of the vibration plate 20.

A back end portion of the vibration plate 20A is fixed to an inner circumference portion of the holding frame 18 by a fixing adhesive 35.

The transmission beam 21A is formed integrally with the vibration plate 20A, and for example, the transmission beam 21A is formed by bending the transmission beam 21A downward from the vibration plate 20A. A width HA in the left and right direction of the bent part 21*a* of the transmission beam 21A bent from the vibration plate 20A is, for example, approximately 0.7 mm which is smaller than the width H of the bent part 21*a* of the transmission beam 21.

Note that the transmission beam 21A may be formed by, for example, a metal column in a round shaft shape.

In the acoustic conversion apparatus 1A, when a current is supplied to the coil 7 to vibrate the vibration portion 16, the vibration of the vibration portion 16 is transmitted from the transmission beam 21A to the vibration plate 20A. The vibration plate 20A is vibrated, and sound according to the vibration of the vibration plate 20A is output. Here, one end portion of the vibration plate 20A is fixed to the inner circumference portion of the holding frame 18, and the vibration plate 20A vibrates in a cantilever state with the bonding part as a fulcrum. In this way, the vibration with the bonding part of the vibration plate 20A as a fulcrum particularly reduces variations of the sound pressure in the high frequency region, and stable sound pressure can be obtained.

Therefore, the acoustic conversion apparatus 1 including the vibration plate 20 with the entire circumference of the outer circumference being isolated from the entire circumference of the inner circumference of the holding frame 18 and the acoustic conversion apparatus 1A including the vibration plate 20A with one end portion being fixed to the inner circumference portion of the holding frame 18 can be used to improve the acoustic characteristics in the entire region of the output region of sound including the low frequency region and the high frequency region without increasing the manufacturing cost or increasing the size.

In addition, since the width H of the bent part 21*a* of the transmission beam 21 in the acoustic conversion apparatus 1 is larger than the width HA of the bent part 21A of the transmission beam 21A in the acoustic conversion apparatus 1A, the strength of the transmission beam 21 is higher than the strength of the transmission beam 21A.

Therefore, the transmission beam 21 and the transmission beam 21A are individually formed with strengths suitable for the low frequency region and the high frequency region, and the acoustic characteristics in the entire region of the output region of sound including the low frequency region and the high frequency region can be further improved.

Furthermore, since the thickness T of the vibration plate 20 in the acoustic conversion apparatus 1 is thicker than the thickness TA of the vibration plate 20A in the acoustic conversion apparatus 1A, the strength of the vibration plate 20 is higher than the strength of the vibration plate 20A.

Therefore, the vibration plate 20 and the vibration plate 20A are individually formed with strengths suitable for the low frequency region and the high frequency region, and the acoustic characteristics in the entire region of the output region of sound including the low frequency region and the high frequency region can be further improved.

Note that the acoustic conversion apparatus 1 and the acoustic conversion apparatus 1A can be used to constitute the sound output equipment 100, thereby using common parts for the acoustic conversion apparatus 1 and the acoustic conversion apparatus 1A except for the vibration plate units 3 and 3A, because only the configuration of part of the vibration plate unit 3A of the acoustic conversion apparatus 1A is different from the vibration plate unit 3.

Therefore, the design of the sound output equipment 100 can be facilitated, and the manufacturing cost can be reduced.

Note that a low-pass filter can be incorporated into the acoustic conversion apparatus 1, and a high-pass filter can be incorporated into the acoustic conversion apparatus 1A to thereby reduce overlapping of high-pitched sound and low-pitched sound to secure favorable acoustic characteristics in the respective regions of the low frequency region and the high frequency region.

<Present Technique>

The present technique can have the following configurations.

(1)

An acoustic conversion apparatus including:

a drive unit including a yoke formed by a magnetic material, magnets attached to the yoke, a coil to which a drive current is supplied, and an armature provided with a vibration portion that vibrates when the drive current is supplied to the coil; and a vibration plate unit including a holding frame including an opening, a film covering the opening and pasted on the holding frame, a vibration plate pasted on the film and held inside of the holding frame, and a transmission beam that transmits vibration of the vibration portion to the vibration plate, in which an entire circumference of an outer circumference of the vibration plate is isolated from an entire circumference of an inner circumference of the holding frame.

(2)

The acoustic conversion apparatus according to (1) above, in which a distance between the entire circumference of the outer circumference of the vibration plate and the entire circumference of the inner circumference of the holding frame is constant.

(3)

The acoustic conversion apparatus according to (1) or (2) above, in which the inner circumference at corner portions of the holding frame is formed in a curved shape.

(4)

The acoustic conversion apparatus according to any one of (1) to (3) above, in which the outer circumference at corner portions of the vibration plate is formed in a curved shape.

(5)

The acoustic conversion apparatus according to any one of (1) to (4) above, in which the transmission beam is formed by bending the transmission beam from the vibration plate.

(6)

The acoustic conversion apparatus according to any one of (1) to (5) above, in which the transmission beam includes a base portion continuous with the vibration plate, and a coupling portion continuous with the base portion and coupled to the vibration portion, and a width of the base portion is larger than a width of the coupling portion.

(7)

The acoustic conversion apparatus according to (6) above, in which the width of the base portion and the width of the coupling portion are both constant.

(8)

The acoustic conversion apparatus according to any one of (1) to (7) above, in which reinforcing ribs are formed on the vibration plate.

(9)

The acoustic conversion apparatus according to any one of (1) to (8) above, in which a rib is formed on the transmission beam.

(10)

The acoustic conversion apparatus according to any one of (1) to (9) above, further including:

a storage unit including a case body that stores the drive unit and the vibration plate unit, and a cover body, the storage unit being provided with a sound output hole that outputs sound generated when the vibration is transmitted to the vibration plate.

(11)

Sound output equipment including:

a first acoustic conversion apparatus and a second acoustic conversion apparatus, both the first acoustic conversion apparatus and the second acoustic conversion apparatus including a drive unit including magnets, a coil to which a drive current is supplied, and an armature provided with a vibration portion that vibrates when the drive current is supplied to the coil, and a vibration plate unit including a holding frame including an opening, a film covering the opening and pasted on the holding frame, a vibration plate pasted on the film and held inside of the holding frame, and a transmission beam that transmits vibration of the vibration portion to the vibration plate, in which an entire circumference of an outer circumference of the vibration plate in the first acoustic conversion apparatus is isolated from an entire circumference of an inner circumference of the holding frame, and one end portion of the vibration plate in the second acoustic conversion apparatus is fixed to an inner circumference portion of the holding frame.

(12)

The acoustic conversion apparatus according to (11) above, in which the transmission beam is formed by bending the transmission beam from the vibration plate in both the first acoustic conversion apparatus and the second acoustic conversion apparatus, and a width of a bent part of the transmission beam bent from the vibration plate in the first acoustic conversion apparatus is larger than a width of a bent part of the transmission beam bent from the vibration plate in the second acoustic conversion apparatus.

(13)

The acoustic conversion apparatus according to (11) or (12) above, in which a thickness of the vibration plate in the first acoustic conversion apparatus is thicker than a thickness of the vibration plate in the second acoustic conversion apparatus.

REFERENCE SIGNS LIST

1 . . . Acoustic conversion apparatus, 2 . . . Drive unit, 3 . . . Vibration plate unit, 4 . . . Storage unit, 5 . . . Yoke, 6 . . . Magnet, 7 . . . Coil, 9 . . . Armature, 16 . . . Vibration portion, 18 . . . Holding frame, 18*c* . . . Opening, 19 . . . Film, 20 . . . Vibration plate, 20*a* . . . Reinforcing rib, 21 . . . Transmission beam, 21*a* . . . Bent part, 21*b* . . . Rib, 22 . . . Corner portion, 22*b* . . . Inner circumference, 23 . . . Corner portion, 23*b* . . . Inner circumference, 24 . . . Corner portion, 24*a* . . . Outer circumference, 25 . . . Corner portion, 25*a* . . . Outer circumference, 26 . . . Base portion, 27 . . . Coupling portion, 29 . . . Case body, 30 . . . Cover body, 30*a* . . . Sound output hole, 1A . . . Acoustic conversion apparatus, 3A . . . Vibration plate unit, 20A . . . Vibration plate, 21A . . . Transmission beam, 100 . . . Sound output equipment

The invention claimed is:

1. An acoustic conversion apparatus, comprising:

a drive unit that includes:

a plurality of magnets;

a coil configured to receive a drive current; and an armature, wherein the armature comprises a vibration portion configured to vibrate based on the received drive current; and a vibration plate unit that includes:

a holding frame including an opening;

a film on the holding frame, wherein the film covers the opening;

a vibration plate on the film, wherein the vibration plate is inside the holding frame; and a transmission beam configured to transmit vibration of the vibration portion to the vibration plate, wherein an entire portion of an outer circumference of the vibration plate is isolated from an entire portion of an inner circumference of the holding frame, and a distance between the entire portion of the outer circumference of the vibration plate and the entire portion of the inner circumference of the holding frame is constant.

2. The acoustic conversion apparatus according to claim 1, wherein the inner circumference at a plurality of corner portions of the holding frame is in a curved shape.

3. The acoustic conversion apparatus according to claim 1, wherein the outer circumference at a plurality of corner portions of the vibration plate is in a curved shape.

4. The acoustic conversion apparatus according to claim 1, wherein the transmission beam is a continuous portion of the vibration plate.

5. The acoustic conversion apparatus according to claim 1, wherein the transmission beam includes:

a base portion continuous with the vibration plate; and a coupling portion continuous with the base portion and coupled to the vibration portion, wherein a width of the base portion is larger than a width of the coupling portion.

6. The acoustic conversion apparatus according to claim 5, wherein each of the width of the base portion and the width of the coupling portion is a constant value.

7. The acoustic conversion apparatus according to claim 1, wherein the vibration plate includes a plurality of reinforcing ribs.

8. The acoustic conversion apparatus according to claim 1, wherein the transmission beam includes a rib.

9. The acoustic conversion apparatus according to claim 1, wherein the vibration plate is configured to generate sound based on the vibration of the vibration portion, and the acoustic conversion apparatus further comprises a storage unit that includes:

a case body that comprises the drive unit and the vibration plate unit;

a cover body; and a sound output hole configured to output the generated sound.

10. A sound output equipment, comprising:

a first acoustic conversion apparatus and a second acoustic conversion apparatus, wherein each of the first acoustic conversion apparatus and the second acoustic conversion apparatus includes:

a drive unit that includes:

a plurality of magnets;

a coil configured to receive a drive current; and an armature, wherein the armature comprises a vibration portion configured to vibrate based on the received drive current; and a vibration plate unit that includes:

a holding frame including an opening;

a film on the holding frame, wherein the film covers the opening;

a vibration plate on the film, wherein the vibration plate is inside the holding frame; and a transmission beam configured to transmit vibration of the vibration portion to the vibration plate, wherein an entire portion of an outer circumference of the vibration plate in the first acoustic conversion apparatus is isolated from an entire portion of an inner circumference of the holding frame in the first acoustic conversion apparatus, a distance between the entire portion of the outer circumference of the vibration plate in the first acoustic conversion apparatus and the entire portion of the inner circumference of the holding frame in the first acoustic conversion apparatus is constant, and one end portion of the vibration plate in the second acoustic conversion apparatus is fixed to an inner circumference portion of the holding frame in the second acoustic conversion apparatus.

11. The sound output equipment according to claim 10, wherein the transmission beam is a continuous portion of the vibration plate in both the first acoustic conversion apparatus and the second acoustic conversion apparatus, and a width of a bent part of the transmission beam in the first acoustic conversion apparatus is larger than a width of a bent part of the transmission beam in the second acoustic conversion apparatus.

12. The sound output equipment according to claim 10, wherein a thickness of the vibration plate in the first acoustic conversion apparatus is larger than a thickness of the vibration plate in the second acoustic conversion apparatus.

13. The acoustic conversion apparatus according to claim 1, wherein the transmission beam is bent downward from the vibration plate, and the transmission beam is integral to the vibration plate.

* * * * *